US009566630B2

(12) United States Patent
Sines

(10) Patent No.: US 9,566,630 B2
(45) Date of Patent: Feb. 14, 2017

(54) PUNCH SURFACE TEXTURING FOR USE IN THE MANUFACTURING OF METALLIC CONTAINERS

(71) Applicant: Ball Corporation, Broomfield, CO (US)

(72) Inventor: James A. Sines, Broomfield, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 15/199,499

(22) Filed: Jun. 30, 2016

(65) Prior Publication Data

US 2017/0001231 A1 Jan. 5, 2017

Related U.S. Application Data

(60) Provisional application No. 62/187,575, filed on Jul. 1, 2015.

(51) Int. Cl.

| | |
|---|---|
| ***B21D 22/28*** | (2006.01) |
| ***B21D 51/26*** | (2006.01) |
| ***B21D 37/20*** | (2006.01) |
| ***B21D 22/30*** | (2006.01) |
| ***B21B 17/02*** | (2006.01) |

(52) U.S. Cl.

CPC ..... *B21D 22/28* (2013.01); *B21B 17/02* (2013.01); *B21D 22/30* (2013.01); *B21D 37/20* (2013.01); *B21D 51/26* (2013.01)

(58) Field of Classification Search

CPC ..... B21B 1/227; B21B 17/02; B21B 22/16; B21D 22/28; B21D 51/26; B21D 37/20; B21D 22/30; B21D 17/02

USPC ..... 72/476

See application file for complete search history.

(56) References Cited

U.S. PATENT DOCUMENTS

| | | | | |
|---|---|---|---|---|
| 496,601 | A * | 5/1893 | Edge | B21D 22/16 72/68 |
| 4,870,846 | A * | 10/1989 | Budrean | B21D 17/02 72/344 |
| 5,892,589 | A | 4/1999 | Beckett et al. | |
| 8,904,911 | B2 | 12/2014 | Nordlin | |
| 9,308,570 | B2 | 4/2016 | Dunwoody et al. | |
| 9,327,333 | B2 | 5/2016 | Blue | |

(Continued)

FOREIGN PATENT DOCUMENTS

| | | |
|---|---|---|
| CN | 103702780 | 4/2014 |
| DE | 202013005049 | 7/2013 |

(Continued)

OTHER PUBLICATIONS

International Search Report and Written Opinion for international (PCT) Patent Application No. PCT/US16/40651, mailed Sep. 16, 2016, 7 pages.

*Primary Examiner* — David B Jones
(74) *Attorney, Agent, or Firm* — Sheridan Ross P.C.

(57) ABSTRACT

A punch sleeve utilized in forming metallic containers, including food and beverage containers, is provided. The punch sleeve comprises two or more different surface textures. In one embodiment, the outer surface of the punch sleeve comprises three regions and each region has a different surface texture. Additionally, a method of texturing two or more different surface textures on an exterior surface of a punch sleeve used in a metallic container manufacturing process is provided. An apparatus for providing two or more surface textures on a punch sleeve used in a metal container manufacturing process is also provided.

20 Claims, 6 Drawing Sheets

(56) References Cited

U.S. PATENT DOCUMENTS

| | | | | |
|---|---|---|---|---|
| 9,334,078 | B2 | 5/2016 | Riley et al. | |
| 9,387,530 | B2 | 7/2016 | Fowler et al. | |
| 9,481,022 | B2 | 11/2016 | McClung et al. | |
| 2013/0239644 | A1 | 9/2013 | McClung et al. | |
| 2014/0000333 | A1 | 1/2014 | Farnham | |
| 2014/0190235 | A1 | 7/2014 | Yannone et al. | |
| 2015/0209848 | A1* | 7/2015 | Kopplin | B21B 1/227 428/659 |
| 2016/0214164 | A1 | 7/2016 | Dunwoody et al. | |

FOREIGN PATENT DOCUMENTS

| | | |
|---|---|---|
| EP | 2531409 | 12/2012 |
| JP | S577334 | 1/1982 |
| WO | WO 2009/100972 | 8/2009 |
| WO | WO 2011/049775 | 4/2011 |
| WO | WO 2011/095595 | 8/2011 |
| WO | WO 2011/128347 | 10/2011 |
| WO | WO 2013/017485 | 2/2013 |
| WO | WO 2013/173398 | 11/2013 |
| WO | WO 2014/110387 | 7/2014 |
| WO | WO 2014/164796 | 10/2014 |
| WO | WO 2014/164945 | 10/2014 |
| WO | WO 2015/181791 | 12/2015 |

* cited by examiner

PUNCH SURFACE TEXTURING FOR USE IN THE MANUFACTURING OF METALLIC CONTAINERS

RELATED APPLICATIONS

This application claims the benefit of U.S. Provisional Patent Application Ser. No. 62/187,575, filed Jul. 1, 2015, entitled "Punch Surface Texturing for Use in the Manufacturing of Metallic Containers," which is hereby incorporated by reference in its entirety.

FIELD OF THE INVENTION

Embodiments of the present invention generally relate to punch tooling utilized in forming metallic containers, and more specifically to punch tooling with surface texturing utilized in forming metallic food and beverage containers.

BACKGROUND OF THE INVENTION

Light-weight metal containers, including food and beverage containers, and the tooling employed to manufacture and form the metal food and beverage containers are generally known in the art. Typically, it is desired to manufacture metal food and beverage containers with as little material and the highest rates of production as possible, while maintaining desired quality characteristics. In typical metal forming processes used in metal container manufacturing, the metal is sized through various stages of tooling, which forms the desired shape and size of the container. The process often starts cutting a circular metal "blank" out of a sheet of metal. Then the metal blank (typically aluminum) placed into a cupping press, where the blank is "drawn" or pulled up into the shape of a cup, which has a diameter of about 3.5 inches to 4.0 inches and a height of about 1.3 inches for traditional 12 oz. cans. The following steps and processes typically work the cup (e.g., in a bodymaker machine) through numerous ironing and redrawing operations. This process reduces the wall thicknesses of the starting material and elongates the container into the desired final container shape. Here, a sleeve holds the cup in place and a punch is lowered swiftly into the cup and redraws the cup to a diameter of about 2.6 inches and a height of 2.25 inches for traditional 12 oz. cans. The punch (also called a punch sleeve) then pushes the cup against multiple ironing rings (typically three, also called ironing die), which stretch and thin the cup walls such that the cup for a traditional 12 oz. can is 5 inches tall. This entire process (the redrawing and ironing) is done in one continuous punch stroke.

The typical process of ironing deforms the metal between an ironing die and a punch sleeve. The metal is deformed under ultra-high forming pressures and loads, where the metal climbs or elongates up the punch surface as the container wall thickness is reduced and the container height is increased. The friction of the tools in the ironing process often determines the resultant quality of the ironing process.

Punch tooling (punch and die) is often made of hardened steel or tungsten carbide. A die is located on the opposite side of the workpiece and supports the material around the perimeter of the container. There is a small amount of clearance between the punch and the die to prevent the punch from sticking in the die. The amount of clearance needed depends on the thickness of the workpiece (i.e., the metallic container), with thicker materials requiring more clearance, but the clearance is always less than the thickness of the workpiece.

Traditional treatments of the punch surface finish have been consistently monolithic applications to amend the surface finish in an effort to control friction and removability of the can from the tooling once ironed. The friction of the punch, the ironing load, and the speed of the punch often determines the defect rates. Such defects are known as tearoffs. "Tearoffs" are a primary defect observed in the normal ironing process, where metal containers that experience excessive tensile loads have a portion of the container which breaks away from the remainder of the cylindrical container. The punch finish has a direct effect on the tear off frequency. Traditional treatments of the punch surface include polished surfaces or crosshatched surfaces that are applied to the entire surface of the punch such that the punch has a single surface treatment. Punch surface texture supports and improves container "stripability," i.e., removal from the punch and ironing die. Thus, punch surface finishes are used to facilitate and improve stripability and, as a result, reduce the defect rates of tear-offs during the manufacturing process.

Common treatments of the punch surface include scoring the sidewall of the punch sleeve in crosshatching patterns. The angle and the coarseness of the crosshatching patterns may vary from punch to punch.

All ductile materials stretch to some extent during punching, which often causes the punch to stick in the container. If this happens, the punch must be physically pulled back out of the container and the container must be pulled off of the punch. This process is known as "stripping" because you are stripping the can from the punch and the defect is called "removability." Additionally, the finer the finish on the punch, the more difficult the stripability (i.e., the ability to easily remove the can from the punch sleeve without excessive damage).

A third defect common in metal container manufacturing is due to the interaction of the punch's normal surface treatments in relationship to ironing forces and the actual releasing of ironing pressure during discharge of metal from the ironing dies. These defects are often described as "ears," "pinch points," or "feathered edges." Ears are ripples at the top of the metal container after the drawing and ironing process. Additionally, ears are elongated regions with an irregular area that causes unequal loading of the ironing die and the resultant defects multiply creating feathered edges, pulled ears, or pinch points.

The material of the punch is often a very durable material, such as carbides, ceramics, and/or tool steel. However, due to millions and millions of cycles these finished surfaces degrade over time due to friction. The degradations cause deformation inconsistencies and changes to the sidewall characteristics of the metal container. Numerous defects can occur and the container walls may contain defects that require removal from the production stream and ultimately reduce the efficiency of the production process.

SUMMARY OF THE INVENTION

Various embodiments and configurations of the present invention relate to a novel system, device, and method for providing surface texturing on a punch used to make metal food and beverage containers. The novel punch surface texture provided herein reduces the defect rate during the punching process. Features of the present invention may be employed in a wide range of food and beverage container manufacturing, including metallic cans and metallic bottles.

It is one aspect of various embodiments of the present invention to provide a punch sleeve with specific surface texturing to facilitate the manufacture of metallic containers, including cans and bottles. The metal of the container is ironed over the surface of the punch sleeve with significant force and pressure as the metal walls of the container are forced through dies and are compressed and placed into tension. Therefore, deformations of the metal occur as a result of the surface treatment of the punch.

Thus, it is one aspect of various embodiments of the present invention to provide a punch surface treatment that addresses and resolves specific quality defects. For example, the present invention can reduce and eliminate the quality defects caused by the ironing processes by uniquely designing the surface texture coarseness, finish treatment, and placement of textured regions on the exterior surface of the punch.

It is a further aspect of various embodiments of the present invention to provide punch surface texturing that improves container quality, reduces spoilage rates, and substantially eliminates the quality defect of slivers. Slivers are created with normal crosshatch patterns as metal flakes and particles (i.e., "slivers") become trapped in the grooves of the crosshatch texture. These metal particles then become ironed into the container walls during post-ironing operations. For example, a particle or multiple particles are created in the first or second ironing operations, then are deposited on or attached to the container walls during the third or fourth ironing operations. Embodiments of the present invention reduce slivers by reducing the intensity of the debris fields created during the container manufacturing process, which reduces the number of defects. For example, using a punch sleeve according to embodiments of the present invention reduces the number of defective containers from 50 defects an hour using traditional punch sleeves to zero defects an hour using a punch sleeve according to embodiments of the present invention.

Another aspect of various embodiments of the present invention is to provide punch surface texturing with a crosshatch pattern having a specific angle and roughness (micron level) that is designed to reduce the tear off rates and optimize production quality and throughput while maintaining stripability.

The ability of the container to be removed from the punch efficiently at high speeds without damage is critical to lightweight metal container manufacturing. Thus, one aspect of various embodiments of the present invention is to provide punch surface texturing that improves and enables better stripping on lower wall thicknesses and lighter containers at higher rates of production (i.e., speeds).

One aspect of various embodiments of the present invention is to provide a punch with various surface textures that also uses at least one normal crosshatch pattern to retain the stripability of the surface finish. Therefore, the speed and integrity of the lightweight metal container is retained, while the quality defects are eliminated or minimized.

It is one aspect of various embodiments of the present invention to provide a metal can punch with various surface textures. It is another aspect of various embodiments of the present invention to provide a punch surface treatment with specific positional and regionalization of the texturing. Thus, in some embodiments, various surface textures are applied to the punch surface at critical regions to optimize and improve metal container manufacturing quality, reliability, speed, and throughput. Additionally, embodiments of the present invention retain the draw and iron process bandwidth, retain the capability for stripping, improve sliver suppression, and improve optimal edge quality. In one embodiment of the present invention, the food or beverage container punch comprises two or more surface textures. Further, the food or beverage container punch can comprise of three distinct surface finishes. Alternatively, the punch can comprise four distinct surface finishes.

It is another aspect of various embodiments of the present invention to provide a metal bottle punch with various surface textures. The threaded and neck areas of bottles are hyper sensitive to deep crosshatch patterns. Therefore, a polished or control surface finish in the neck and thread regions of the bottle can be optimized as needed for the desired results. Specifically, in some embodiments, the punch is smooth in the bottle's threaded area to reduce the occurrence of false positive curl cracks during machine vision inspections. Further, having a smooth punch surface in the bottle's threaded area improves the ability to form threads on the bottle during later steps in the bottle manufacturing process.

In one embodiment of the present invention, the punch surface contains two or more regions and each region contains a different predetermined texture. The surface texture is often described herein using the "$R_a$" value for the surface. $R_a$ is a common roughness (also called surface roughness) parameter used in the art. $R_a$ is the arithmetic average of the roughness profile of the surface, meaning that $R_a$ is calculated using an arithmetic average of absolute values from a two-dimensional roughness profile. Further, specific finishes and $R_a$ ranges are designed into interactional regions of the punch to improve the container quality during the ironing process. The application of surface finishes in specific regions allows the container walls to be less tapered, less oval, and less feathered and it also reduces or eliminates slivers.

For example, in one embodiment, the punch outer surface comprises polished regions or surfaces less than 8 $R_a$ positioned at the corresponding heights of the container during the redraw process through the second container progressions such that the cut edge movements during ironing are optimized. The specific heights of these regions depend on the size of the finished container, which can be anywhere from 3 oz. to 32 oz. to 750 mL.

In some embodiments, the punch sleeve is made of carbide. In other embodiments, the punch sleeve is made of steel or other metal alloy. In still other embodiments, the punch sleeve is made of a ceramic material.

In various embodiments of the present invention, a metal container punch is provided that is manufactured with conventional manufacturing equipment. Alternatively, in some embodiments, the punch surface treatments are applied with a custom machine. In other embodiments, the custom surface treatments are applied by hand with skilled workmanship. However, the best application of treating/texturing multiple regions of the punch surface must remove and maintain constant material thickness and resultant diameters of each of the textured regions. Thus, the machine is designed to remove the material of the base carbide, tool steel, or ceramic punch such that the entire surface of the punch is concentric, linear, and parallel. The resultant metal container manufacturing process requires a consistent punch surface (meaning, for example, concentric, linear, and parallel) to produce consistent wall thickness and container weights.

As appreciated by one skilled in the art, the present invention could be used to manufacture 12 oz. cans, smaller metallic containers between about 3-11.5 oz., and larger metallic containers between about 13 oz. and 32 oz.

Embodiments of the present invention can also be used to manufacture 500 mL, 587 mL, and 750 mL metallic containers.

In one embodiment of the present invention, a punch used in a process to form metal containers is provided, the punch comprises a nose positioned on one end of the punch; a trailing edge positioned opposite the nose on a second end; a cylindrical portion positioned between the nose and the trailing edge; and an outer surface comprising: a first region proximate the nose and having a first length and a first surface finish; a second region proximate to the first region and having a second length and a second surface finish, wherein the second surface finish is different than the first surface finish; and a third region positioned proximate to the second region and to the trailing edge, the third region having a third length and a third surface finish, wherein the third surface finish is different than the second surface finish.

In additional embodiments, the first surface finish comprises a crosshatch pattern and the second surface finish is polished between an $R_a$ 2 and an $R_a$ 8 finish. The third surface finish can also comprise a crosshatch pattern. In various embodiments, the first length of the first region is between about 1.0 inches and 2.0 inches, the second length of the second region is between about 1.0 inches and 2.0 inches, and the third length of the third region is about 1.0 and 2.5 inches.

In one embodiment of the present invention, a method of texturing an exterior surface of a punch sleeve used in metallic container manufacturing is provided, comprising (a) providing the punch sleeve comprising a nose positioned on one end of the punch; a trailing edge positioned opposite the nose on a second end; a cylindrical portion positioned between the nose and the trailing edge; and an outer surface comprising a first region proximate the nose; a second region positioned proximate to the first region; and a third region position proximate to the second region and positioned proximate the trailing edge; (b) applying a first crosshatch pattern to the first region using a first diamond impregnated tab with a first micron finish; (c) applying a second crosshatch pattern to the third region using a second diamond impregnated tab with a second micron finish; and (d) polishing the first region, the second region, and the third region.

In a further embodiment of the present invention, the method further comprises using an air pressure of about 30 psi when applying the first crosshatch pattern; and positioning the first crosshatch pattern at an angle between about 30 degrees and 60 degrees relative to a longitudinal axis of the punch sleeve. In various embodiments of the present invention, at least one of the first crosshatch pattern and the second crosshatch pattern is applied by rotating the punch at a first speed while simultaneously contacting an exterior surface of the punch with at least one of the first diamond impregnated tab and the second diamond impregnated tab operating at a second speed.

In one embodiment, a punch used in a manufacturing process to form metal containers is provided comprising: a nose positioned on one end of the punch; a trailing edge positioned opposite the nose on a second end of the punch; a cylindrical portion positioned between the nose and the trailing edge; and an outer surface comprising: a first region positioned proximate to the nose and having a first length and a first surface finish; a second region positioned proximate to the trailing edge and having a second length and a second surface finish, wherein the second surface finish is different than the first surface finish; and a third region positioned proximate to at least one of the first region and the second region and having a third length and a third surface finish, wherein the third surface finish is different than the second surface finish. In a further embodiment, the first surface finish comprises a first crosshatch pattern, and wherein the second surface finish comprises a second crosshatch pattern, the second crosshatch pattern is a 10-60 micron level crosshatch pattern and the first crosshatch pattern is a coarser crosshatch pattern than the second crosshatch pattern, and the third surface finish is polished between an $R_a$ 2 and an $R_a$ 8 finish. In some embodiments, the first region extends from a first point on the punch proximate the nose to a second point on the punch, and wherein the first length is between about 15 percent and about 35 percent of a total length of the punch, the third region extends from the second point on the punch to a third point on the punch, and wherein the third length is between about 15 percent and about 35 percent of the total length of the punch, and the second region extends from the third point on the punch to a fourth point on the punch, and wherein the second length is between about 15 percent and about 35 percent of the total length of the punch. In still further embodiments, the first length of the first region is between about 1.0 inches and about 2.0 inches, the second length of the second region is between about 1.0 inches and about 2.5 inches, and the third length of the third region is between about 1.0 inches and about 2.0 inches. In some embodiments, the punch has a fourth region positioned between the first region and the third region and having a fourth length and a fourth surface finish.

In one embodiment, a method of texturing an exterior surface of a punch sleeve used in a metallic container manufacturing process is provided comprising: providing the punch sleeve, comprising: a nose positioned on one end of the punch sleeve; a trailing edge positioned opposite the nose on a second end; a cylindrical portion positioned between the nose and the trailing edge; and an outer surface comprising: a first region proximate the nose; a second region positioned proximate to the trailing edge; and a third region positioned between the first region and the second region; applying a first textured pattern to at least one of the first region, the second region, and the third region using a first etching tool with a first micron finish; applying a second textured pattern to at least one of the first region, the second region, and the third region using a second etching tool with a second micron finish, wherein the second textured pattern is applied to a different region than the first textured pattern; and polishing the first region, the second region, and the third region. In further embodiments, the method includes using a force between about 10 pounds and about 20 pounds when applying the first textured pattern, and wherein the first textured pattern is a crosshatch pattern. In a further embodiment, the method comprises positioning the first textured pattern at an angle between about 30 degrees and about 60 degrees relative to a longitudinal axis of the punch sleeve. In another embodiment, the method comprises positioning the crosshatch pattern at an angle between about 30 degrees and about 60 degrees relative to a longitudinal axis of the punch sleeve. In some embodiments, at least one of the first textured pattern and the second textured pattern is a crosshatch pattern. In one embodiment, at least one of the first textured pattern and the second textured pattern is applied by rotating the punch sleeve at a first speed while simultaneously contacting an exterior surface of the punch sleeve with at least one of the first etching tool and the second etching tool, and wherein the at least one of the first etching tool and the second etching tool moves along a longitudinal axis of the punch sleeve at a second speed while simultaneously contacting the exterior surface of the punch sleeve. In one embodiment, wherein the first region has a first length between about 1.0 inches and about 2.0 inches, the second region has a second length between about 1.0 inches and about 2.5 inches, and the third region has a third length between about 1.0 inches and about 2.0 inches.

In another embodiment, an apparatus for providing surface texturing on a punch sleeve used in a metal container manufacturing process is provided comprising: a connection mechanism positioned proximate to a first end of the machine, the connection mechanism configured to interconnect to one end of the punch sleeve, and wherein the connection mechanism rotates the punch sleeve around a longitudinal axis of the punch sleeve; an arm positioned parallel to the longitudinal axis of the punch sleeve; and an etching tool for applying a first surface texture to a first region of an outer surface of the punch sleeve, said etching tool moveably interconnected to the arm such that the etching tool can slide along the arm and move along the longitudinal axis of the punch sleeve. In further embodiments, the apparatus comprises a means to apply a force on the etching tool in a direction toward the punch sleeve, wherein the connection mechanism rotates the punch sleeve while the etching tool simultaneously moves along the longitudinal axis of the punch sleeve. In various embodiments, the apparatus comprises a second etching tool for applying a second surface texture to a second region of the outer surface of the punch sleeve, and a programmable logic system which operably communicates with the machine to control the positioning of the etching tool with respect to the punch sleeve. In still further embodiments, the etching tool comprises a diamond impregnated tab with a micron finish and the second etching tool comprises a second diamond impregnated tab with a second micron finish. In various embodiments, the etching tool further comprises an etching tool holder or a tab holder, wherein the etching tool holder or the tab holder is interconnected to the arm and is configured to hold the etching tool or tab. In some embodiments, the apparatus further comprises an electronic display for displaying content, a processor, memory, and a communication interface to connect to a communication network.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1:
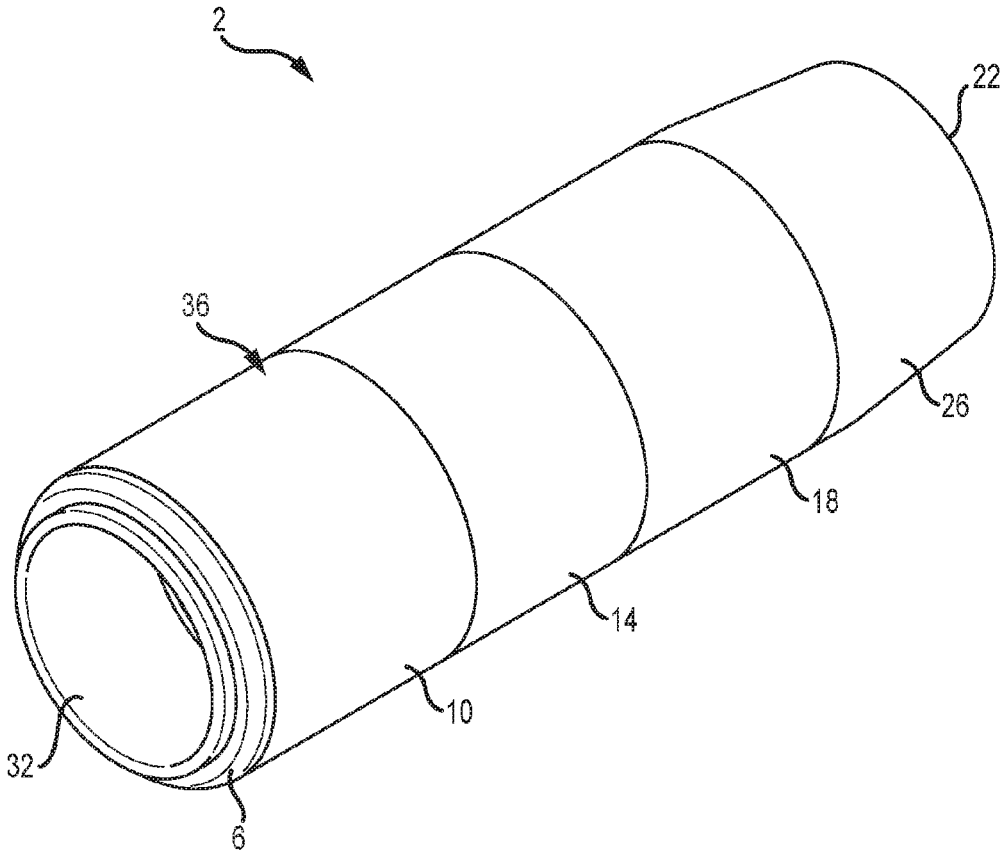
FIG. 1 is a front perspective view of a punch sleeve generally having a nose, a trailing edge, and three distinct textured surfaces therebetween.

To assist in the understanding of the embodiments of the present invention the following list of components and associated numbering found in the drawings is provided herein:

| Component No. | Component Name |
|---|---|
| 2 | Punch Sleeve |
| 6 | Nose |
| 10 | First Region |

-continued

| Component No. | Component Name |
|---|---|
| 14 | Second Region |
| 18 | Third Region |
| 22 | Trailing Edge |
| 26 | End Section |
| 32 | Inner Surface |
| 36 | End Portion |
| 40 | Punch Sleeve |
| 44 | First Region |
| 48 | Second Region |
| 52 | Third Region |
| 56 | End Section |
| 70 | Punch Sleeve |
| 74 | Precision Mounting Surface |
| 90 | Punch Sleeve |
| 94 | First Region |
| 98 | Second Region |
| 102 | Third Region |
| 106 | End Section |
| 120 | Punch Sleeve |
| 124 | First Region |
| 128 | Second Region |
| 132 | Third Region |
| 136 | End Section |
| 200 | Machine |
| 204 | Punch Sleeve |
| 208 | Marker |
| 212 | Holder |
| 216 | Arm |
| 218 | Channel or Groove |
| 220 | Connection Piece |
| 224 | Marker Marks |
| D1 | Diameter |
| D2 | Diameter |
| D3 | Diameter |
| L1 | Length |
| L2 | Length |
| L3 | Length |
| L4 | Length |
| L5 | Length |
| L6 | Length |
| L7 | Second Region |

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning.

The accompanying drawings, which are incorporated in and constitute a part of the specification, illustrate embodiments of the invention and together with the summary of the invention given above and the detailed description of the drawings given below, serve to explain the principles of the invention.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

Various embodiments of the present invention are described herein and as depicted in the drawings. It is expressly understood that although the figures depict metal container punches, and methods and systems for using and manufacturing the same, the present invention is not limited to these embodiments. It should also be understood that the terms "container" and "container body" may be used interchangeably in some instances.

Referring to FIG. 1, a punch sleeve 2 is shown (also called a "punch" herein). This punch sleeve 2 is designed to punch metal cans or other metallic containers. In one embodiment, the punch sleeve 2 is designed to punch lightweight 7.5 oz. metal cans, which can be manufactured using only two ironing operations. However, in some embodiments, the lightweight 7.5 oz. metal cans are manufactured using three ironing operations. Thus, the ideal dimensions and proportions of the various regions for a punch 2 for manufacturing lightweight 7.5 oz. metal cans are shown in FIG. 1. However, in other embodiments, other dimensions and proportions can be used on a punch sleeve to manufacture different sized metallic containers, e.g., 12 oz. cans, 16 oz. cans, 24 oz. cans, etc. Additionally, the lengths of the regions 10, 14, 18, 26 may be different in different embodiments. Further, additional regions may also be included in other embodiments.

The punch sleeve 2 has a nose 6, a trailing edge 22, an inner surface 32, an outer surface 36, and a mounting transition section 26 proximate the trailing edge 22. The mounting transition section 26 is tapered from the diameter of the third region 18 to the diameter of the ram at the trailing edge 22 of the punch 2. The ram is the part of the punch machine to which the punch 2 is mounted or interconnected at the trailing edge 22 of the punch 2. The outer surface 36 of the punch sleeve 2 comprises three (or more) regions: a first region 10, a second region 14, and a third region 18. In various embodiments, the nose 6 of the punch sleeve 2 does not have crosshatching. Further, the mounting transition section 26 also does not have crosshatching because this portion of the punch 2 is not intended to contact the metallic container. The surface of the mounting transition section 26 is "as ground."

The first region 10 has a coarse crosshatch pattern and extends from a point above the punch nose 6 to the height of the redrawn cup in one embodiment or to about 0.5 inches below the height of the redrawn cup in a second embodiment. The redrawn cup is the first stage of the drawn and ironing process. This stage transforms the cup into a smaller diameter cylinder, which is then ready for the ironing process. It is a redrawing process, and not necessarily an ironing process, but some metal shape and transformation takes place. Elimination of wrinkles in the container during the redrawing process is key to optimize performance. The positioning of the first region 10 enables the edge of the cup to clear the first region's 10 crosshatch pattern by a sufficient amount to not hinder performance. Note that the length of the first region 10 may change slightly for each specific can size and starting metal gauge. A rougher surface $R_a$ finish coarseness may be used in the first region 10 because this is the thickest container wall and the lowest compressive loads of the punch processes are experienced in the first region 10. Stripability is also maintained by using a surface finish coarseness that facilitates stripping.

In the embodiment shown, the second region 14 extends from the end of the first region 10 to the top edge of the last progression height, meaning the second region 14 extends to the height of the container after the last ironing progression, which may be a first ironing progression, second ironing progression, third ironing progression, etc. In one embodiment, the second region 14 has a surface pattern that is polished to below an $R_a$ 12 finish. In another embodiment, the second region 14 has a surface pattern that is polished to between an $R_a$ 2 and an $R_a$ 8 finish. The second region 14's surface is relatively smooth and without scratches or grooves because scratches and grooves create slivers of small metal particles, which cause defects in later processing steps. The surface treatment of the second region 14 is designed to suppress particle fragments and sliver generation from the ironing process. Each can size has a banded region (which corresponds to the second region 14) that is located at a starting height just below the height of the redrawn cup and extends up the punch cylinder 2 to just above the height of the second ironing progression height in a normal 3-die tool pack arrangement. On multiple ironing die embodiments, the banded section would extend to just above the edge locations of the final ironing height. The surface texture and length of the second region 14 is specifically designed to eliminate debris and sliver generation.

In some embodiments, the second region 14 is broken into multiple regions for applications where distances between progression heights dictate some roughness for improved stripability. However, the top edge of each progression height would optimize sliver or debris suppression with specific surface texturing as described above. Thus, having a smooth the second region 14 eliminates or reduces the reattachment of the slivers created during the metal container manufacturing process.

The third region 18 may extend from the end of the second region 14 to a point at or above the transition from a midwall to a topwall of the container. In some embodiments, the third region 18 is interconnected to the end portion 36. The desired surface finish for the third region 18 is the lightest micron level required, which aids stripability. The surface finish of the third region 18 is generally between a 10-60 micron level crosshatch pattern. Thus, the crosshatch pattern on the third region 18 is lighter than the crosshatch pattern on the first region 10. The pattern angularity may result in some process benefit but ideally the crosshatch pattern in the third region 18 is between about 30-60 degrees relative to the longitudinal axis of the punch 2. Alternatively, the crosshatch pattern may be positioned at an angle between 20 degrees and 80 degrees relative to the longitudinal axis of the punch 2.

In some embodiments, the third region 18 is polished prior to crosshatching. Thus, a polished surface is first produced and then a crosshatch pattern is applied on top of the polished surface. In other embodiments, the order is reversed: a crosshatch pattern is applied to the third region 18 and then a polished treatment is applied to the third region 18 to smooth the surface edges and sharpness. Further, punches used to manufacture bottles can also benefit from a polished the third region 18 because the bottle drawn and ironed container requires smoothness in the neck area for optimal threading. The smooth region of the punch used to create the neck portion of the bottle may be the third region 18 in some embodiments or may be a fourth region (not shown) in other embodiments, depending on the height of the bottle and the progression-height correspondence. The region of the punch used to create the neck portion of the bottle must have a surface finish that is specially applied and designed for improved bottle necking, coating adhesion, and threading performance. Because the threaded and neck areas of bottles are hyper sensitive to deep crosshatch patterns, a polished or control surface finish in the neck and thread regions of the bottle is typically used.

Figure 2:
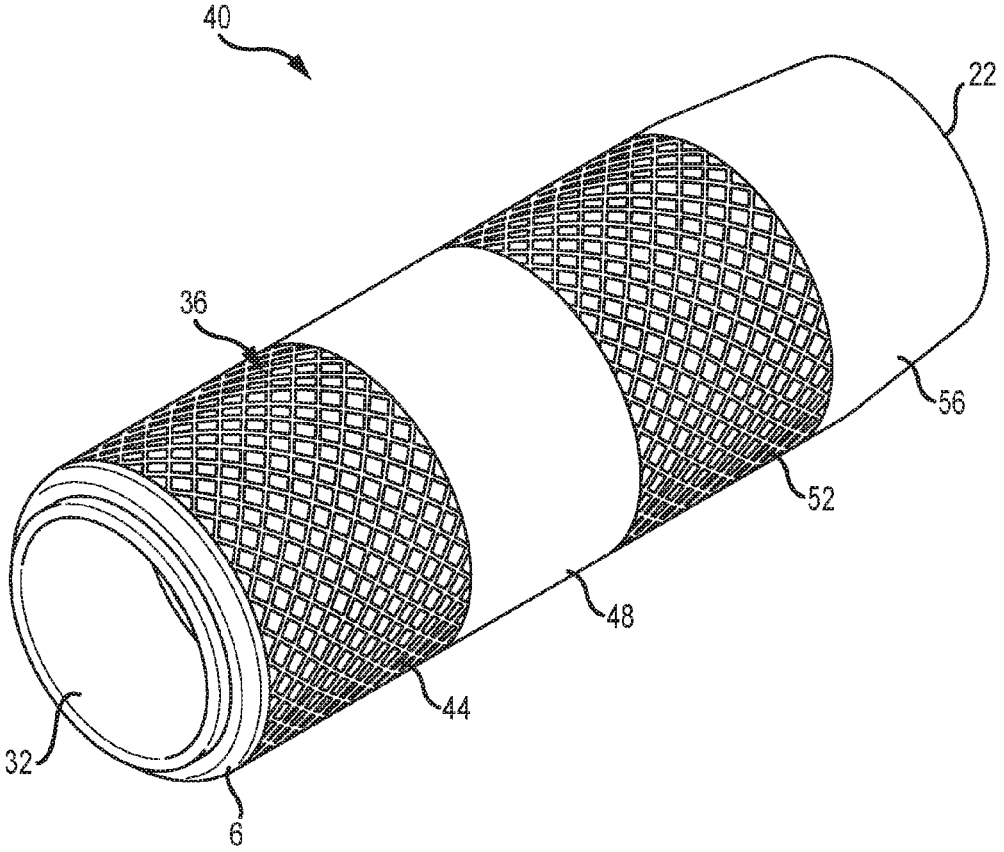
FIG. 2 is a front perspective view of a punch sleeve where a first region and a third region are exaggerated for illustration purposes.

FIG. 2 is another embodiment of a punch sleeve 40 with three regions: a first region 44, a second region 48, and a third region 52. The punch sleeve 40 has a nose 6, a trailing edge 22, an inner surface 32, an outer surface 36, and a mounting transition section 26 proximate the trailing edge 22. The mounting transition section 56 is tapered from the diameter of the third region 52 to the diameter of the ram at the trailing edge 22 of the punch 40. Further, the mounting transition section 56 does not have crosshatching because this portion of the punch 40 is not intended to contact the metallic container. The surface of the mounting transition section 56 is "as ground." The crosshatch patterns shown on the first region 44 and the second region 48 are exaggerated for illustration purposes. Thus, the angle and pattern of the crosshatching applied to the first region 44 and the second region 48 can clearly be seen in FIG. 2. The locations of the regions 44, 48, 52 are determined by the position of the container at each stage of the drawn and ironing process, as was discussed in FIG. 1. Specifically, the first region 44 has a coarse crosshatch pattern and extends from a point above the punch nose 6 to the height of the redrawn cup or to about 0.5 inches below the height of the redrawn cup. A rougher surface $R_a$ finish coarseness may be used in the first region 44 because this is the thickest container wall and the lowest compressive loads of the punch processes are experienced in the first region 44. Stripability is also maintained by using a surface finish coarseness that facilitates stripping. The second region 48 extends from the end of the first region 44 to the top edge of the last progression height, meaning the second region 48 extends to the height of the container after the first ironing progression. The third region 52 may extend from the end of the second region 48 to a point at or above the transition from a midwall to a topwall. The desired surface finish for the third region 52 is the lightest micron level required, which aids stripability. The surface finish of the third region 52 is generally between a 10-60 micron level crosshatch pattern.

Figure 3:
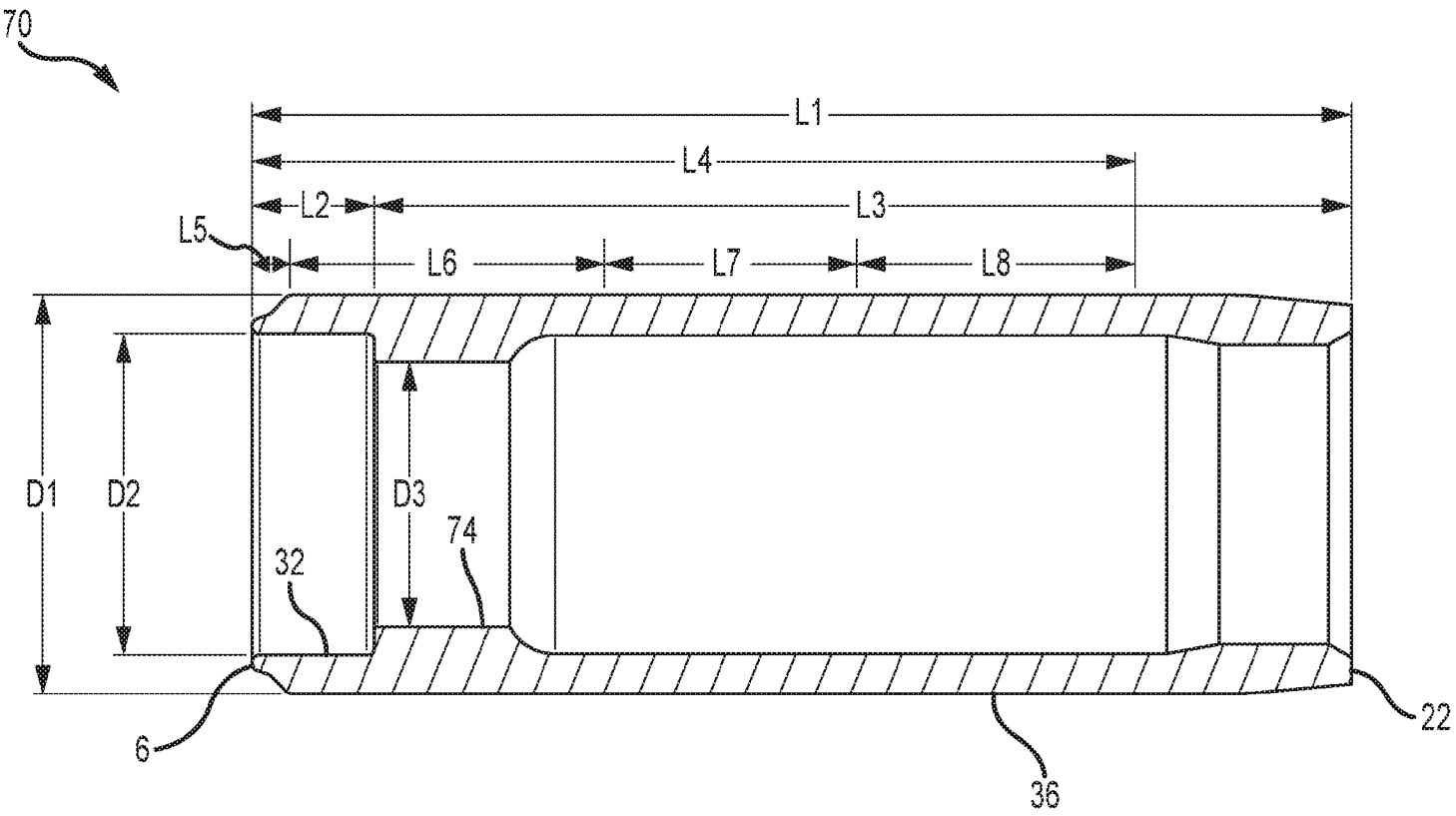
FIG. 3 is a cross-sectional view of a punch sleeve taken along a longitudinal line of the punch sleeve.

FIG. 3 shows a cross-section view of the punch sleeve 70 cut down the longitudinal axis of the punch sleeve 70. The nose 6 of the punch sleeve 70 is positioned on one end and the trailing edge 22 is positioned on the other end. In this embodiment, the punch sleeve 70 is designed to punch lightweight 7.5 oz. metal cans, which are manufactured using only two ironing operations. Thus, ideal dimensions for the various regions are provided herein below. However, in other embodiments, other dimensions can be used to manufacture different sized metallic containers, e.g., 12 oz. cans, 16 oz. cans, 24 oz. cans, etc. Additional regions may also be included in other embodiments. For example, in one embodiment a 24 oz. can is manufactured using three ironing operations. Therefore, the punch used to make the 24 oz. can may have four regions to accommodate the additional ironing operation. Alternatively, the 24 oz. can punch may only have three regions and the length of the second region L7 will be longer than is shown in FIG. 3. One skilled in the art will appreciate embodiments of punch sleeves, and methods of producing punch sleeves, that have one region, two regions, three regions, four regions, five regions, etc. can fall within the scope of the present invention. Each food and beverage container size has specific heights and regions (i.e., locations) for maintaining stripability and optimizing performance, which reduces undesirable quality defects. Further, the patterns of the crosshatch areas are adjusted based on the number of ironing steps or die setups in the forming process. Additionally, the shape and geometry of the nose 6 of the punch 70 shown is typical for a metal beverage can. This shape and geometry will likely stay the same for other sized beverage cans. However, this shape and geometry may change for metal wine bottles and metal food containers. Furthermore, the nose 6 of the punch 70 typically will not have crosshatching.

In FIG. 3, the first region spans length L6 and begins a length L5 from the tip of the nose 6 of the punch sleeve 70. The length L5 is approximately 0.2407 inches (6.114 mm) in one embodiment. The first region ends approximately 1.75 inches (44.5 mm) from the tip of the nose 6 in some embodiments of a punch 70 for a 7.5 oz. can. In the embodiment shown in FIG. 3, the first region has a length L6 between about 1 inch and about 2 inches. In a preferred embodiment of a punch 70 for a 7.5 oz. can, the first region has a length L6 between about 1.25 inches and about 1.75 inches. In a more preferred embodiment of a punch for a 7.5 oz. can, the first region has a length L6 of about 1.5 inches.

In the embodiment shown in FIG. 3, the second region spans length L7 and begins at the end of the first region. The second region ends approximately 3.25 inches (82.6 mm) from the tip of the nose 6 of the punch sleeve 70. In the embodiment of the 7.5 oz. can punch sleeve 70 shown in FIG. 3, the second region has a length L7 between about 1 inch and about 2 inches. In a preferred embodiment of a punch 70 for a 7.5 oz. can, the second region has a length L7 between about 1.25 inches and about 1.75 inches. In a more preferred embodiment of a punch 70 for a 7.5 oz. can, the second region has a length L7 of about 1.5 inches.

In the embodiment shown in FIG. 3, the third region spans length L8 and begins at the end of the second region. The third region ends approximately 5.0 inches (127 mm) from the tip of the nose 6 of the punch sleeve 70. In the embodiment of the 7.5 oz. can punch sleeve 70 shown in FIG. 3, the third region has a length L8 between about 1 inch and about 2.5 inches. In a preferred embodiment of a punch 70 for a 7.5 oz. can, the third region has a length L8 between about 1.5 inches and about 2.0 inches. In a more preferred embodiment of a punch 70 for a 7.5 oz. can, the third region has a length L8 of about 1.75 inches.

In FIG. 3, the length L1 of the punch 70 is about 6.250 inches, the length L2 is about 0.700 inches, the length L3 is about 5.550 inches, and the length L4 is about 5.000 inches. In this embodiment, the outer diameter D1 of the punch 70 is between about 2.257 inches and about 2.2630 inches. In some embodiments, the outer diameter D1 of the punch 70 is constant from the point where the first region begins proximate the nose to the point where the third regions ends proximate the trailing edge 22. Somewhere beyond the point where the third region ends (i.e., a point between the third region and the trailing edge 22) the outer diameter of the punch 70 tapers to a smaller outer diameter. Thus, the outer diameter D1 of the first region is the same as the outer diameter D1 of the second region, which is the same as the outer diameter D1 of the third region. In other embodiments, the outer diameter D1 of the punch 70 varies along the length L1 of the punch 70, for example for punches used to manufacture bottles. Thus, the outer diameter D1 of the first region can be different than the outer diameter D1 of the second region, which can be different than the outer diameter D1 of the third region. The inner diameter D2 of the punch 70 proximate the nose 6 is about 1.8112 inches. The inner surface 32 of the punch has a raised portion called a journal or a precision mounting surface 74 that is bolted to the ram of the punching machine. The inner diameter D3 of the precision mounting surface 74 is about 1.501 inches.

Figure 4:
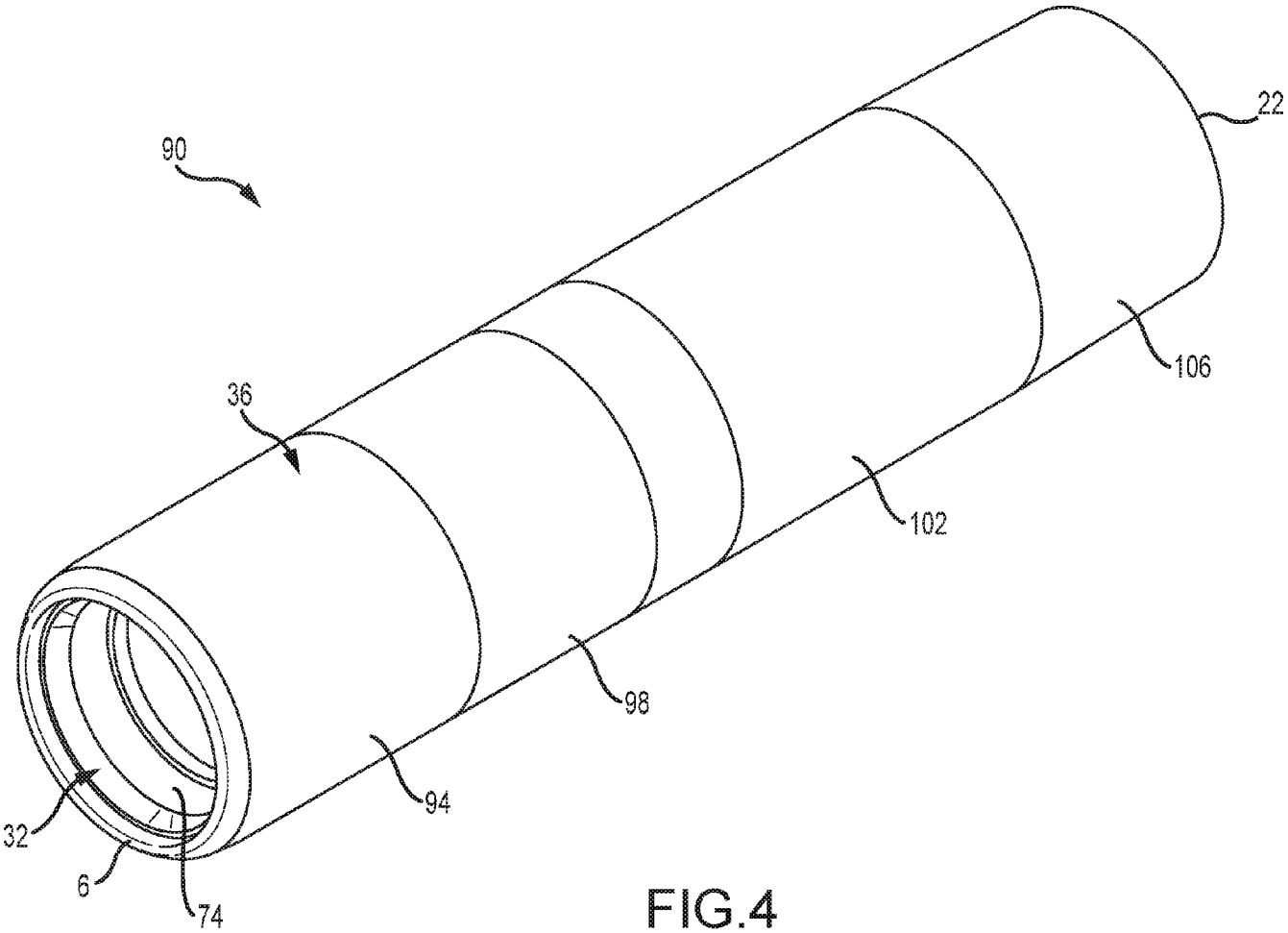
FIG. 4 is a front perspective view of a punch sleeve.

FIG. 4 shows an alternate embodiment of a punch sleeve 90 designed to punch metal cans. This punch sleeve may be used to form a 24 oz. can, or as appreciated by one skilled in the art any alternative sized container. The punch sleeve 90 has a nose 6, a trailing edge 22, an inner surface 32 with a precision mounting surface 74, a mounting transition section 106 proximate the trailing edge 22, and an outer surface 36 with three regions: a first region 94, the second region 98, and a third region 102. The locations of the regions 94, 98, 102 are determined by the position of the container at each stage of the drawn and ironing process, as was discussed in FIG. 1. Specifically, the first region 94 has a coarse crosshatch pattern and extends from a point above the punch nose 6 to the height of the redrawn cup or to about 0.5 inches below the height of the redrawn cup. A rougher surface $R_a$ finish coarseness may be used in the first region 94 because this is the thickest container wall and the lowest compressive loads of the punch processes are experienced in the first region 94. Stripability is also maintained by using a surface finish coarseness that facilitates stripping. The second region 98 extends from the end of the first region 94 to the top edge of the last progression height, meaning the second region 98 extends to the height of the container after the first ironing progression. In one embodiment, the second region 98 is polished. The third region 102 may extend from the end of the second region 98 to a point at or above the transition from a midwall to a topwall. The desired surface finish for the third region 102 is the lightest micron level required, which aids stripability. The surface finish of the third region 102 is generally between a 10-60 micron level crosshatch pattern. The mounting transition section 106 does not have crosshatching because this portion of the punch 90 is not intended to contact the metallic container. The surface of the mounting transition section 106 is "as ground." Further, the mounting transition section 106 is tapered from the diameter of the third region 102 to the diameter of the ram at the trailing edge 22 of the punch 90.

Figure 5:
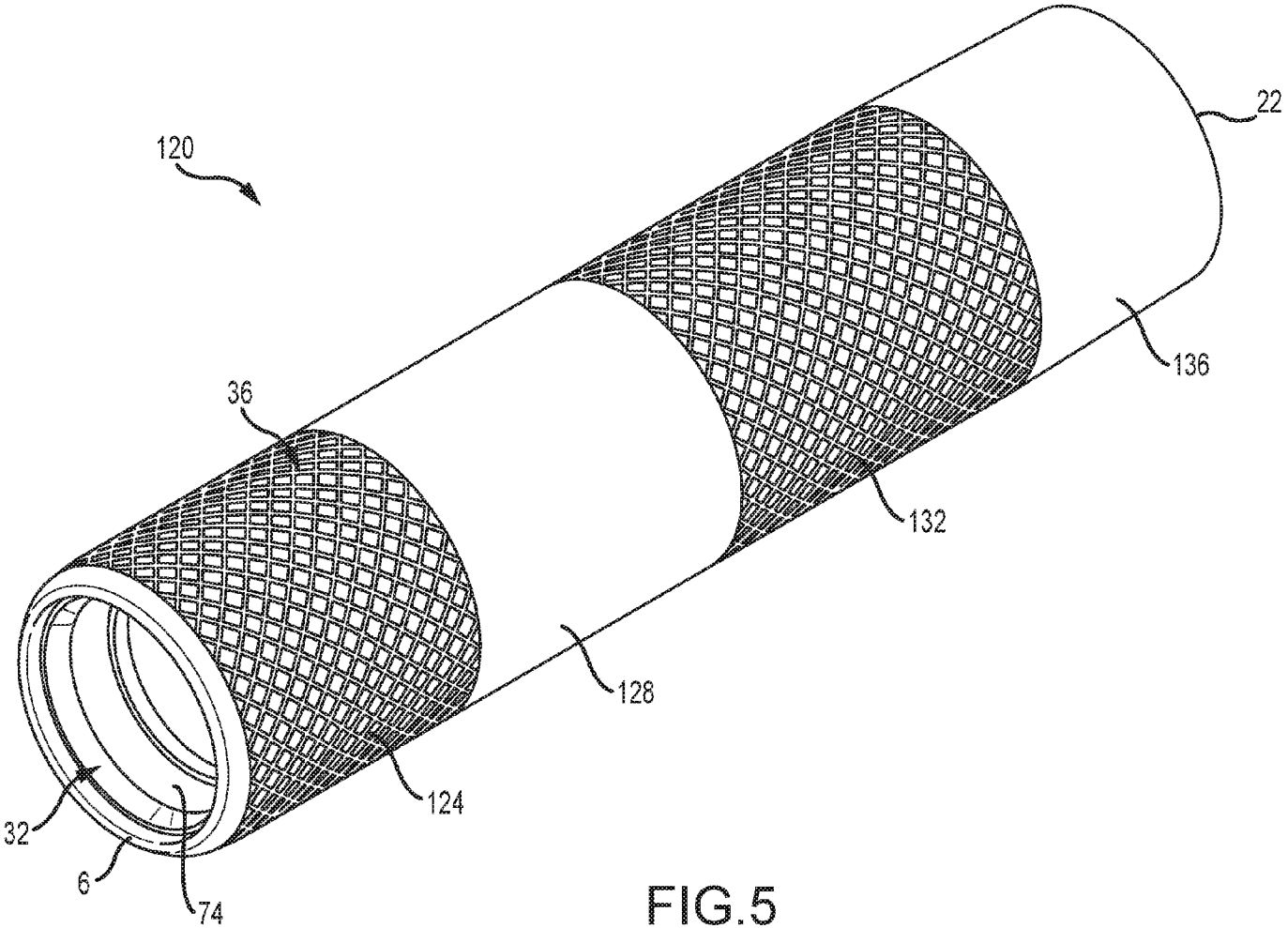
FIG. 5 is a front perspective view of a punch sleeve where a first region and a third region are exaggerated for illustration purposes.

FIG. 5 is another embodiment of a punch sleeve 120 with three regions: a first region 124, a second region 128, and a third region 132. The punch sleeve 120 has a nose 6, a trailing edge 22, an inner surface 32 with a precision mounting surface 74, an outer surface 36, and a mounting transition section 136 proximate the trailing edge 22. The crosshatch patterns used on the first region 124 and the third region 132 are exaggerated for illustration purposes. Thus, the angle and pattern of the crosshatching applied to the first region 124 and the third region 132 can clearly be seen in FIG. 5. The surface of the mounting transition section 136 is "as ground." The locations of the regions 124, 128, 132 and the mounting transition section 136 are determined by the position of the container at each stage of the drawn and ironing process, as was discussed in aforementioned figures and will not be repeated here.

Figure 6:
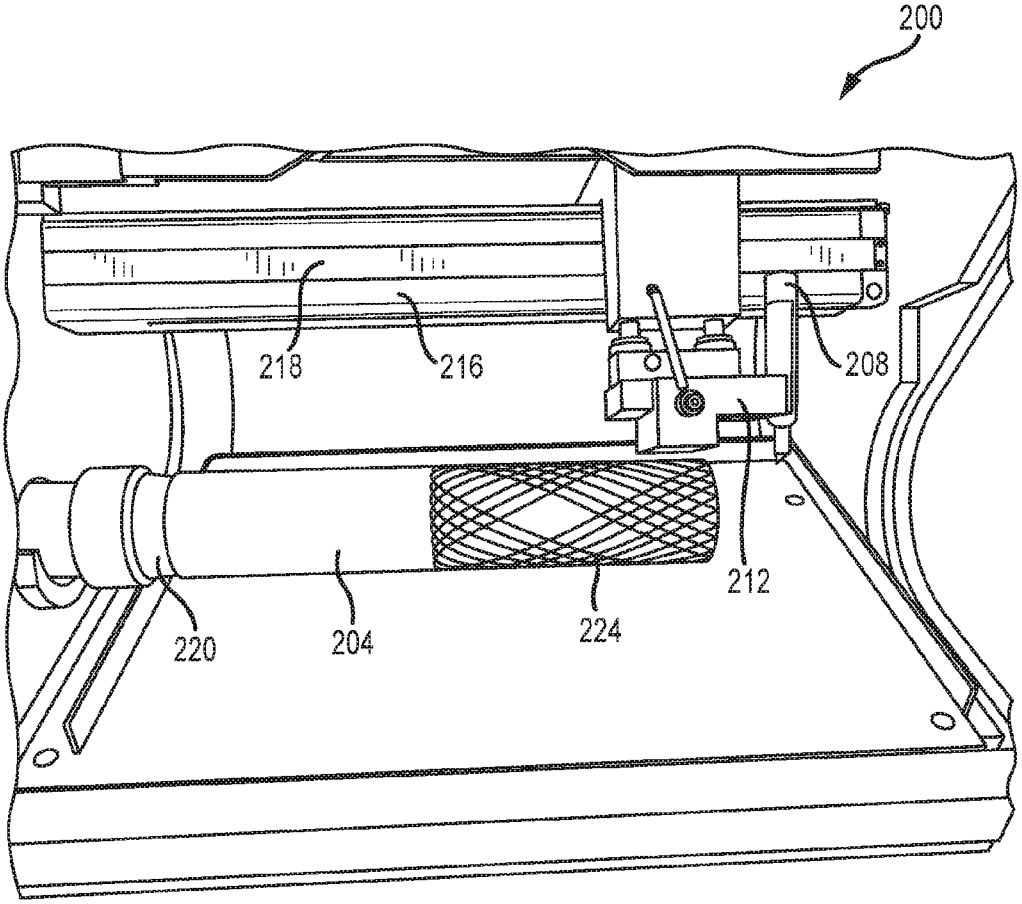
FIG. 6 is a side elevation view of a punch sleeve being manufactured on a machine used to produce the punch's surface texture according to embodiments of the present invention.

FIG. 6 depicts a punch sleeve 204 positioned on the surface finish applying machine 200. The machine 200 adds the surface finish, which can include a crosshatch pattern, to the outer surface of the punch sleeve 204. In the drawing, a crosshatch pattern has been applied to a portion of the punch sleeve 204 and the positioning of the crosshatch pattern is shown via the marker marks 224. The machine 200 includes a connection piece 220 and the punch sleeve 204 is interconnected to the machine 200 via the connection piece 220. The machine 200 rotates the connection piece 220 such that the punch sleeve 204 is rotated around its longitudinal axis and the surface finish can be applied in a crosshatch pattern. An etching tool, which may be a diamond-impregnated tab or other tab or tool, is positioned where the marker 208 is shown in FIG. 6. The etching tool (or marker as is the case in the illustrative example in FIG. 6) is held by a holder 212 that slides along the arm 216 of the machine 200 such that the etching tool can move up and down the longitudinal axis of the punch sleeve 204. In some embodiments, the etching tool and holder 212 are one piece and in other embodiments they are separate components such that only the etching tool must be changed when a different etching tool is desired to create different surface textures on the punch sleeve 204. The arm is substantially linear and oriented substantially parallel to the longitudinal axis of the punch sleeve 204. The arm 216 comprises a groove or channel 218 running along the arm's longitudinal axis. The channel 218 is substantially linear and oriented substantially parallel to the longitudinal axis of the punch sleeve 204, which allows the holder 212 to travel within the channel and along the length of the arm 216. The holder 212 is interconnected to the arm 216 via the channel or groove 218 such that the holder 212 can move along the arm 216 and along the punch sleeve 204. The crosshatch pattern or other texturing pattern is created by the punch sleeve 204 rotating at a predetermined speed as the etching tool moves up and down the longitudinal axis of the punch sleeve 204 (by moving along the arm 216 of the machine 200) while the etching tool is touching the outer surface of the punch sleeve 204. A predetermined pressure or force is applied to the external surface of the punch sleeve 204 via the etching tool to create a finish with the desired characteristics, e.g., the depths of the grooves of the crosshatch pattern. In one embodiment, the amount of force applied to the punch sleeve 204 outer surface by the etching tool is between about 10 pounds and about 20 pounds. In one embodiment, the amount of force applied to the punch sleeve 204 outer surface by the etching tool is about 15 pounds. The distance the etching tool moves up and down the outer surface of the punch sleeve 204 is predetermined by the user and set as a parameter for the machine 200. Thus, the surface texture can be applied to the desired portion (e.g., a first region, a second region, a third region, etc.) of the punch sleeve 204 outer surface. Further, as appreciated by one skilled in the art, the crosshatch pattern can be modified in an almost endless number of patterns, including being modified to be more or less dense, to be at different angles, to have alternative geometric patterns, and to have different lengths of texturing.

In some embodiments, the machine comprises a processor, memory, an input device (which can be a touch-screen display surface configured to receive touch input), a display to display content, and a power source (which can be a battery). The machine can further include data storage, software, a user interface, an input device, an output device, a communication network, such as Bluetooth or WiFi, and/or a communication interface for communicating with another smart phone or computing device and/or the communication network. In further embodiments, the processor can include any processor capable of performing instructions encoded in software or firmware. Further, the processor can be provided to execute instructions contained within the memory and/or data storage. The processor can comprise a controller or application specific integrated circuit (ASIC) having or capable of performing instructions encoded in logic circuits. The memory may be used to store programs or data, including data comprising content. As examples, the memory may comprise RAM, SDRAM, or other solid state memory. Alternatively or in addition, data storage may be provided. The data storage may generally include storage for programs and data. In one embodiment, the machine comprises a programmable logic system that operably communicates with the machine to control the positioning of the etching tool with respect to the punch sleeve. As such, a user can program the machine to create any number of desired surface textures on the desired regions of the punch sleeve. The machine then will automatically texture and polish the desired portions of the punch sleeve.

In some embodiments, the method of providing surface texture on the punch sleeve comprises applying a first textured pattern to the first region using a first etching tool with a first micron finish, applying a force between about 10 pounds and 20 pounds on the punch sleeve to scratch the punch sleeve, and positioning the textured pattern at between about 30 degrees and 60 degrees relative to the longitudinal axis of the punch. In one embodiment, the first etching tool is a first diamond impregnated tab. In some embodiments, the textured pattern is a crosshatch pattern. In some embodiments, the machine used to apply the textured pattern and other surface finishes to the outer surface of the punch sleeve uses a pneumatic cylinder and an adjustable air pressure to apply the force on the etching tool on the punch sleeve. In one embodiment, this force is applied by using an air pressure of about 30 psi. In other embodiments, the machine used to apply the textured pattern and other surface finishes to the outer surface of the punch sleeve uses mechanical or hydraulic means of creating pressure or force on the etching tool on the punch sleeve. Next, applying a third textured pattern to the third region using a second etching tool with a second micron finish, using an air pressure of about 30 psi, and positioning the third textured pattern at between about 30 degrees and 60 degrees relative to the longitudinal axis of the punch. In one embodiment, the second etching tool is a second diamond impregnated tab. Then polish the first, second, and third regions of the punch sleeve. Alternatively, the punch may be polished before the textured patterns or crosshatch patterns are applied to the first and third regions. To crosshatch punch sleeves according to embodiments of the present invention, the crosshatching machine will use special cams and special attachments (e.g., working heads) for different surfacing technologies.

Each food and beverage container size has specific heights and regions (i.e., locations) of greater value for maintaining stripability and optimizing performance, which reduces undesirable quality defects. The patterns of the textured area (including the crosshatched areas) are adjusted based on the number of ironing steps or die setups in the forming process.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A punch used in a manufacturing process to form metal containers, comprising:

a nose positioned on one end of the punch;

a trailing edge positioned opposite the nose on a second end of the punch;

a cylindrical portion positioned between the nose and the trailing edge; and an outer surface comprising:

a first region positioned proximate to the nose and having a first length and a first surface finish;

a second region positioned proximate to the trailing edge and having a second length and a second surface finish, wherein the second surface finish is different than the first surface finish; and a third region positioned proximate to at least one of the first region and the second region and having a third length and a third surface finish, wherein the third surface finish is different than the second surface finish.

2. The punch according the claim 1, wherein the first surface finish comprises a first crosshatch pattern, and wherein the second surface finish comprises a second crosshatch pattern.

3. The punch according the claim 2, wherein the second crosshatch pattern is a 10-60 micron level crosshatch pattern and the first crosshatch pattern is a coarser crosshatch pattern than the second crosshatch pattern.

4. The punch according the claim 2, wherein the third surface finish is polished between an $R_a$ 2 and an $R_a$ 8 finish.

5. The punch according the claim 1, wherein the first region extends from a first point on the punch proximate the nose to a second point on the punch, and wherein the first length is between about 15 percent and about 35 percent of a total length of the punch.

6. The punch according the claim 5, wherein the third region extends from the second point on the punch to a third point on the punch, and wherein the third length is between about 15 percent and about 35 percent of the total length of the punch.

7. The punch according the claim 6, wherein the second region extends from the third point on the punch to a fourth point on the punch, and wherein the second length is between about 15 percent and about 35 percent of the total length of the punch.

8. The punch of claim 1, wherein the first length of the first region is between about 1.0 inches and about 2.0 inches, the second length of the second region is between about 1.0 inches and about 2.5 inches, and the third length of the third region is between about 1.0 inches and about 2.0 inches.

9. The punch of claim 1, further comprising a fourth region positioned between the first region and the third region and having a fourth length and a fourth surface finish.

10. A method of texturing an exterior surface of a punch sleeve used in a metallic container manufacturing process, comprising:

providing the punch sleeve, comprising:

a nose positioned on one end of the punch sleeve;

a trailing edge positioned opposite the nose on a second end;

a cylindrical portion positioned between the nose and the trailing edge; and an outer surface comprising:

a first region proximate the nose;

a second region positioned proximate to the trailing edge; and a third region positioned between the first region and the second region;

applying a first textured pattern to at least one of the first region, the second region, and the third region using a first etching tool with a first micron finish;

applying a second textured pattern to at least one of the first region, the second region, and the third region using a second etching tool with a second micron finish, wherein the second textured pattern is applied to a different region than the first textured pattern; and polishing at least one of the first region, the second region, and the third region.

11. The method of claim 10, further comprising:

using a force between about 10 pounds and about 20 pounds when applying the first textured pattern; and wherein the first textured pattern is a crosshatch pattern.

12. The method of claim 11, further comprising positioning the crosshatch pattern at an angle between about 30 degrees and about 60 degrees relative to a longitudinal axis of the punch sleeve.

13. The method of claim 10, wherein at least one of the first textured pattern and the second textured pattern is applied by rotating the punch sleeve at a first speed while simultaneously contacting an exterior surface of the punch sleeve with at least one of the first etching tool and the second etching tool, and wherein the at least one of the first etching tool and the second etching tool moves along a longitudinal axis of the punch sleeve at a second speed while simultaneously contacting the exterior surface of the punch sleeve.

14. The method of claim 10, wherein the first region has a first length between about 1.0 inches and about 2.0 inches, the second region has a second length between about 1.0 inches and about 2.5 inches, and the third region has a third length between about 1.0 inches and about 2.0 inches.

15. An apparatus for providing surface texturing on a punch sleeve used in a metal container manufacturing process, comprising:

a connection mechanism positioned proximate to a first end of the machine, the connection mechanism configured to interconnect to one end of the punch sleeve, and wherein the connection mechanism rotates the punch sleeve around a longitudinal axis of the punch sleeve;

an arm positioned parallel to the longitudinal axis of the punch sleeve; and an etching tool for applying a first surface texture to a first region of an outer surface of the punch sleeve, said etching tool moveably interconnected to the arm such that the etching tool can be selectively positioned along the longitudinal axis of the punch sleeve.

16. The apparatus of claim 15, further comprising a means to apply a force on the etching tool in a direction toward the punch sleeve.

17. The apparatus of claim 15, wherein the connection mechanism rotates the punch sleeve while the etching tool simultaneously moves along the longitudinal axis of the punch sleeve.

18. The apparatus of claim 15, further comprising a second etching tool for applying a second surface texture to a second region of the outer surface of the punch sleeve.

19. The apparatus of claim 15, further comprising a programmable logic system which operably communicates with the machine to control the positioning of the etching tool with respect to the punch sleeve.

20. The apparatus of claim 15, wherein the etching tool comprises a diamond impregnated tab with a micron finish.

* * * * *